US009392367B2

(12) United States Patent
Tanaka

(10) Patent No.: US 9,392,367 B2
(45) Date of Patent: Jul. 12, 2016

(54) SOUND REPRODUCTION APPARATUS AND SOUND REPRODUCTION METHOD

(71) Applicant: CANON KABUSHIKI KAISHA, Tokyo (JP)

(72) Inventor: Atsushi Tanaka, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 291 days.

(21) Appl. No.: 13/869,420

(22) Filed: Apr. 24, 2013

(65) Prior Publication Data

US 2013/0315422 A1 Nov. 28, 2013

(30) Foreign Application Priority Data

May 24, 2012 (JP) ..... 2012-119069

(51) Int. Cl.

| | |
|---|---|
| ***H04R 5/02*** | (2006.01) |
| ***H04R 3/12*** | (2006.01) |
| ***H04S 7/00*** | (2006.01) |
| *H04S 1/00* | (2006.01) |

(52) U.S. Cl.

CPC .. *H04R 3/12* (2013.01); *H04S 7/30* (2013.01); *H04R 2460/13* (2013.01); *H04S 1/005* (2013.01); *H04S 7/307* (2013.01); *H04S 2400/13* (2013.01); *H04S 2420/01* (2013.01)

(58) Field of Classification Search

USPC ..... 381/1, 13, 17, 58, 59, 74, 309, 71.6, 381/71.8

See application file for complete search history.

(56) References Cited

U.S. PATENT DOCUMENTS

| | | | |
|---|---|---|---|
| 4,886,943 | A | 12/1989 | Suzuki et al. |
| 4,897,510 | A | 1/1990 | Tanaka et al. |
| 4,931,965 | A | 6/1990 | Kaneko et al. |
| 5,017,913 | A | 5/1991 | Kaneko et al. |
| 5,070,325 | A | 12/1991 | Tanaka et al. |
| 5,097,102 | A | 3/1992 | Yoshimura et al. |
| 5,097,415 | A | 3/1992 | Yoshimura et al. |
| 5,142,106 | A | 8/1992 | Yoshimura et al. |
| 5,239,138 | A | 8/1993 | Kobayashi et al. |
| 5,500,492 | A | 3/1996 | Kobayashi et al. |
| 5,539,678 | A | 7/1996 | Tanaka et al. |
| 5,565,893 | A | 10/1996 | Sato et al. |
| 5,714,698 | A | 2/1998 | Tokioka et al. |
| 5,726,686 | A | 3/1998 | Taniishi et al. |
| 5,736,979 | A | 4/1998 | Kobayashi et al. |
| 5,805,147 | A | 9/1998 | Tokioka et al. |
| 5,818,429 | A | 10/1998 | Tanaka et al. |
| 5,831,603 | A | 11/1998 | Yoshimura et al. |
| 5,933,149 | A | 8/1999 | Mori et al. |
| 5,936,207 | A | 8/1999 | Kobayashi et al. |

(Continued)

FOREIGN PATENT DOCUMENTS

| | | | |
|---|---|---|---|
| JP | 6-217400 | A | 8/1994 |
| JP | 2011-524151 | A | 8/2011 |

(Continued)

*Primary Examiner* — Vivian Chin
*Assistant Examiner* — Friedrich W Fahnert
(74) *Attorney, Agent, or Firm* — Fitzpatrick, Cella, Harper & Scinto

(57) ABSTRACT

Signals obtained by convoluting opposite phase signals of impulse responses corresponding to current positions of sound collection units attached to right and left suppliers out of impulse responses calculated in association with a plurality of positions to sound signals for right and left ears are supplied to the right and left suppliers, respectively.

13 Claims, 10 Drawing Sheets

(56) References Cited

U.S. PATENT DOCUMENTS

| | | | | |
|---|---|---|---|---|
| 6,072,877 | A * | 6/2000 | Abel | 381/17 |
| 6,091,894 | A * | 7/2000 | Fujita et al. | 703/13 |
| 6,415,240 | B1 | 7/2002 | Kobayashi et al. | |
| 6,965,378 | B2 | 11/2005 | Tanaka | |
| 7,075,514 | B2 | 7/2006 | Tanaka | |
| 7,375,720 | B2 | 5/2008 | Tanaka | |
| 7,589,715 | B2 | 9/2009 | Tanaka et al. | |
| 8,306,243 | B2 | 11/2012 | Kimura et al. | |
| 8,401,201 | B2 | 3/2013 | Tanaka | |
| 2005/0238176 | A1* | 10/2005 | Nakano | 381/1 |
| 2006/0056638 | A1* | 3/2006 | Schobben | 381/17 |
| 2007/0121956 | A1* | 5/2007 | Bai et al. | 381/59 |
| 2007/0291967 | A1* | 12/2007 | Pedersen | 381/309 |
| 2009/0304214 | A1 | 12/2009 | Xiang et al. | |
| 2011/0142255 | A1 | 6/2011 | Tanaka | |
| 2012/0128166 | A1* | 5/2012 | Kim et al. | 381/58 |
| 2012/0328107 | A1* | 12/2012 | Nystrom et al. | 381/17 |
| 2013/0177166 | A1* | 7/2013 | Agevik et al. | 381/74 |
| 2015/0106475 | A1* | 4/2015 | Tan et al. | 709/217 |

FOREIGN PATENT DOCUMENTS

| | | | |
|---|---|---|---|
| WO | 2009/022463 | A1 | 2/2009 |
| WO | 2012/061148 | A1 | 5/2012 |

* cited by examiner

| REGION | MINIMUM X | MAXIMUM X | MINIMUM Y | MAXIMUM Y | TRANSFER FUNCTION L→R | TRANSFER FUNCTION R→L |
|---|---|---|---|---|---|---|
| A | Xamin | Xamax | Yamin | Yamax | HLRa | HRLa |
| B | Xbmin | Xbmax | Ybmin | Ybmax | HLRb | HRLb |
| C | Xcmin | Xcmax | Ycmin | Ycmax | HLRc | HRLc |

SOUND REPRODUCTION APPARATUS AND SOUND REPRODUCTION METHOD

BACKGROUND OF THE INVENTION

1. Field of the Invention

The present invention relates to a sound reproduction technique and, more particularly, to a technique for making three-dimensional sound reproduction.

2. Description of the Related Art

It is a common practice for sound apparatuses which make so-called music reproduction to perform reproduction using stereo components. These apparatuses reproduce different signals from two loudspeakers, left and right, to reproduce music as if a performance were occurring between the loudspeakers. Such a kind of sound localization is often known as "sound image".

A plurality of microphones are used to record music having such a sound image. Sound recording is performed using either stereo microphones used to directly generate right and left signals or a large number of microphones, and after sound recording, the recorded signals are mixed using a sound editing apparatus such as a mixer to provide a stereoscopic effect.

In terms of reproduction environment, not only stereophonic reproduction using two loudspeakers, but also a surround technique which uses loudspeakers arranged behind a listener to reproduce sounds as if they were surrounding the listener is widespread. In such a surround-sound technique, various systems, such as a 5.1-channel system, 7.1-channel system, 9.1-channel system, and the like, have been proposed.

The surround system has prevailed to allow the user to enjoy movie videos and the like with a sense of reality, and along with resolution enhancement of videos and popularization of three-dimensional movies, expectations are raised for an even greater sense of reality.

The surround technique reproduces sounds from positions surrounding a listener. As a technique for reproducing sounds more three-dimensionally, a binaural reproduction technique is known. With binaural reproduction, microphones are arranged at internal ear positions of a dummy head which is the same as a head of a person, and sounds recorded using these microphones are reproduced using headphones.

Using the dummy head, sounds including an HRTF (Head Relations Transfer Function) normally used when one perceives a sound direction can be recorded. This HRTF has different frequency characteristics in correspondence with arrival directions, and by reproducing sound sources convoluted with this HRTF using headphones, a person can listen to reproduced sounds as if he or she were staying on-site. However, with reproduction using headphones, a so-called sound image is reproduced behind or beside a person's head, but it is not reproduced in front of a person's head.

To solve these problems, a technique for reproducing binaural signals recorded using the dummy head via loudspeakers is known. It is known that when the binaural signals are reproduced via the loudspeakers, a sound image is three-dimensionally localized in front of the head.

With this arrangement, a three-dimensional sound image effect is obtained only when sounds from the right and left loudspeakers reach the right and left ears independently. However, sounds from the left loudspeaker also reach the right ear, and vice versa. Such a phenomenon is called crosstalk. In order to reproduce three-dimensional sounds, crosstalk must be cancelled.

Crosstalk in binaural reproduction will be described below with reference to FIG. 11. Referring to FIG. 11, let HLL be a transfer function when a sound of a left loudspeaker 15L reaches the left ear, and HRR be a transfer function when a sound of a right loudspeaker 15R reaches the right ear. At this time, as transfer functions of crosstalk, let HLR be a transfer function when the sound of the left loudspeaker 15L reaches the right ear and HRL be a transfer function when the sound of the right loudspeaker 15R reaches the left ear. Letting SL be a binaural signal for the left ear and SR be a binaural signal for the right ear, sounds SL' and SR', which respectively reach the respective ears, are expressed by:

$$\begin{pmatrix} HLL & HRL \\ HLR & HRR \end{pmatrix}\begin{pmatrix} SL \\ SR \end{pmatrix} = \begin{pmatrix} SL' \\ SR' \end{pmatrix} \tag{1}$$

$$A = \begin{pmatrix} HLL & HRL \\ HLR & HRR \end{pmatrix} \tag{2}$$

In order to reproduce three-dimensional sounds, an inverse matrix of a matrix A given by equation (2) above is convoluted in signals to produce corresponding sounds from the right and left loudspeakers 15R and 15L, so as to cancel crosstalk indicated by dotted lines, as shown in FIG. 11 (Japanese Patent Laid-Open No. 06-217400).

However, with this method, since the transfer functions to the head position are set in advance, and are fixedly used, the head cannot be moved. Also, since cancel signals are superposed on reproduced sounds of the loudspeakers, crosstalk can be canceled for one person at a given position, but a plurality of persons cannot listen to the reproduced sounds at the same time.

SUMMARY OF THE INVENTION

The present invention has been made in consideration of the aforementioned problems, and provides a technique for allowing a plurality of persons to listen to sounds upon execution of three-dimensional sound reproduction.

According to one aspect of the present invention, there is provided a sound reproduction apparatus, which outputs a sound signal for a right ear and a sound signal for a left ear, which are included in a sound signal as a binaural signal, to loudspeakers, comprising: an acquisition unit configured to acquire signals which are output from sound collection units, which are respectively attached to a left supplier configured to directly supply a sound according to a signal to a left ear of a listener and a right supplier configured to directly supply a sound according to a signal to a right ear of the listener, and collect sounds produced from the loudspeakers; a generation unit configured to calculate impulse responses from the signals acquired by the acquisition unit and to generate opposite phase signals of the calculated impulse responses; and a supply unit configured to respectively supply signals, which are obtained by convoluting the signals generated by the generation unit to the sound signal for the right ear and the sound signal for the left ear, to the left supplier and the right supplier, wherein the supply unit respectively supplies, to the left supplier and the right supplier, signals which are obtained by convoluting opposite phase signals of impulse responses corresponding to current positions of the sound collection units attached to the left supplier and the right supplier out of impulse responses calculated by the acquisition unit and the generation unit in association with a plurality of positions to the sound signal for the right ear and the sound signal for the left ear.

According to another aspect of the present invention, there is provided a sound reproduction method to be executed by a sound reproduction apparatus, which outputs a sound signal for a right ear and a sound signal for a left ear, which are included in a sound signal as a binaural signal, to loudspeakers, comprising: an acquisition step of acquiring signals which are output from sound collection units, which are respectively attached to a left supplier configured to directly supply a sound according to a signal to a left ear of a listener and a right supplier configured to directly supply a sound according to a signal to a right ear of the listener, and collect sounds produced from the loudspeakers; a generation step of calculating impulse responses from the signals acquired in the acquisition step and generating opposite phase signals of the calculated impulse responses; and a supply step of respectively supplying signals, which are obtained by convoluting the signals generated in the generation step to the sound signal for the right ear and the sound signal for the left ear, to the left supplier and the right supplier, wherein in the supply step, signals which are obtained by convoluting opposite phase signals of impulse responses corresponding to current positions of the sound collection units attached to the left supplier and the right supplier out of impulse responses calculated in the acquisition step and the generation step in association with a plurality of positions to the sound signal for the right ear and the sound signal for the left ear are respectively supplied to the left supplier and the right supplier.

Further features of the present invention will become apparent from the following description of exemplary embodiments with reference to the attached drawings.

DESCRIPTION OF THE EMBODIMENTS

Figure 1:
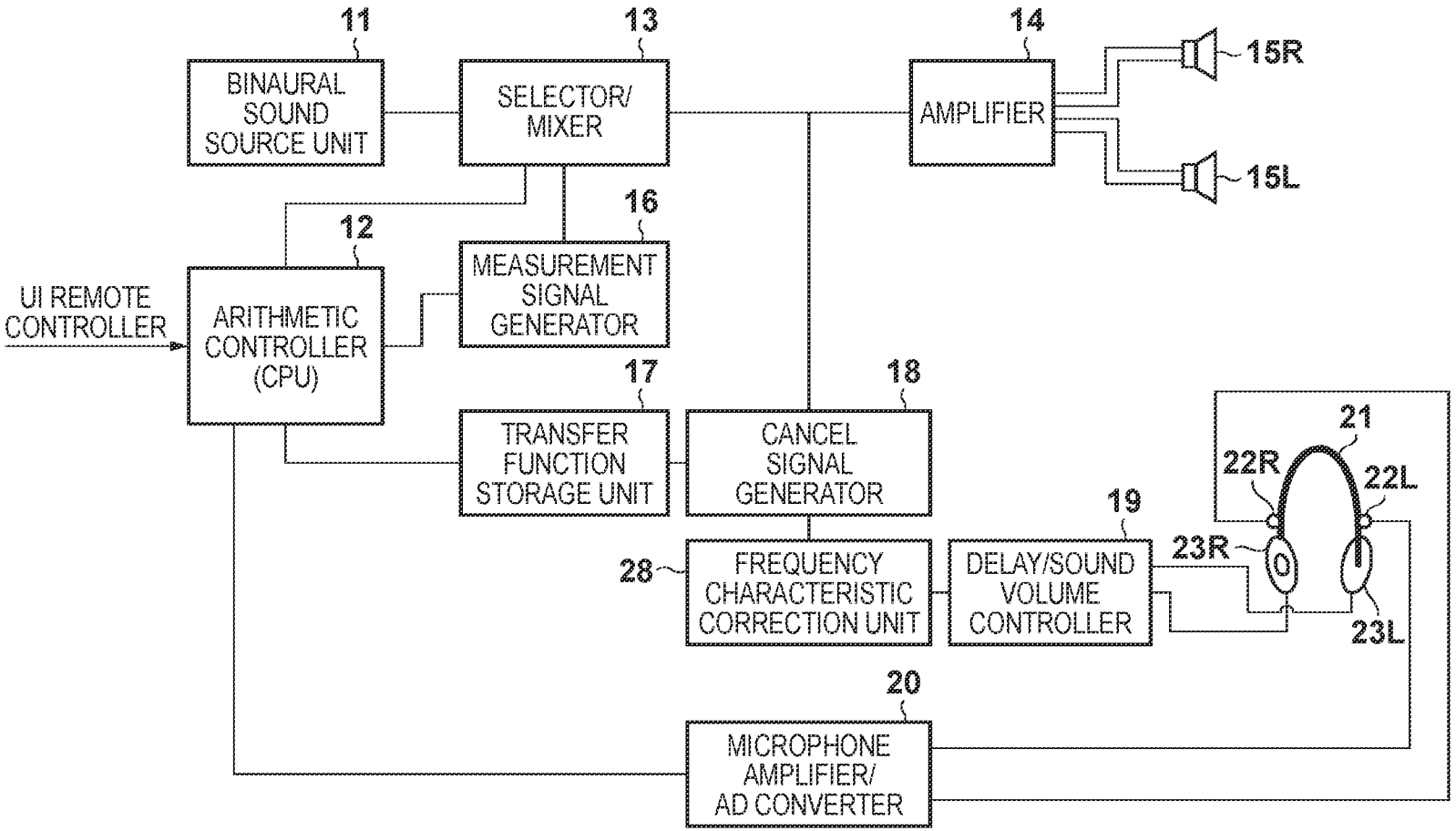
FIG. 1 is a block diagram showing an example of the functional arrangement of a sound reproduction apparatus.

Embodiments of the present invention will be described hereinafter with reference to the accompanying drawings. Note that an embodiment to be described hereinafter represents an example when the present invention is carried out practically, and is one detailed embodiment of an arrangement described in the scope of the claims.

First Embodiment

An example of the functional arrangement of a sound reproduction apparatus according to this embodiment will be described first with reference to the block diagram shown in FIG. 1.

An arithmetic controller 12 includes a CPU, DSP, and the like, and controls operations of respective units included in the sound reproduction apparatus.

A binaural sound source unit 11 supplies a binaural signal including a sound signal for the right ear and that for the left ear to this apparatus. The binaural sound source unit 11 may be either an external device or a function unit in this apparatus. The binaural signal supplied from the binaural sound source unit 11 is input to a selector/mixer 13.

The selector/mixer 13 selects one of the binaural signal supplied from the binaural sound source unit 11 and a measurement signal supplied from a measurement signal generator 16 in accordance with an instruction from the arithmetic controller 12, and outputs the selected signal. Upon reception of a notification indicating that a reproduction mode is set from the arithmetic controller 12, the selector/mixer 13 outputs the binaural signal supplied from the binaural sound source unit 11 to an amplifier 14 and cancel signal generator 18. On the other hand, upon reception of a notification indicating that a measurement mode is set from the arithmetic controller 12, the selector/mixer 13 outputs the measurement signal supplied from the measurement signal generator 16 to the amplifier 14.

The amplifier 14 amplifies the signal supplied from the selector/mixer 13, and outputs the amplified signal to right and left loudspeakers 15R and 15L. Upon reception of the binaural signal from the selector/mixer 13, the amplifier 14 respectively outputs the sound signal for the right ear and that for the left ear, which are included in this binaural signal, to the right loudspeaker 15R required to produce a sound for the right ear and the left loudspeaker 15L required to produce a sound for the left ear. On the other hand, upon reception of the measurement signal from the selector/mixer 13, the amplifier 14 outputs the measurement signal to one of the right and left loudspeakers 15R and 15L. After measurements (to be described later) are complete for the loudspeaker as an output destination, the amplifier 14 outputs the measurement signal to the other loudspeaker in turn.

Upon reception of a notification indicating that the measurement mode is set from the arithmetic controller 12, the measurement signal generator 16 outputs a signal of a sound to be generated to measure an impulse response (transfer function) to the selector/mixer 13 as the measurement signal. As the measurement signal, an MLS signal, sweep signal, TPS signal, or the like can be applied.

The cancel signal generator 18 generates cancel signals by convoluting opposite phase signals (to be described in detail later) stored in a transfer function storage unit 17 to the signals from the selector/mixer 13. More specifically, the cancel signal generator 18 generates a cancel signal for the left ear by convoluting an opposite phase signal (that of HRL) for the left ear to a sound signal (SR) for the right ear from the selector/mixer 13. Also, the cancel signal generator 18 generates a cancel signal for the right ear by convoluting an opposite phase signal (that of HLR) for the right ear to a sound signal (SL) for the left ear from the selector/mixer 13.

A frequency characteristic correction unit 28 corrects frequency characteristics of the cancel signals generated by the cancel signal generator 18, and outputs the corrected cancel signals to a delay/sound volume controller 19. The delay/sound volume controller 19 applies delay adjustment and sound volume adjustment to the cancel signals, the frequency characteristics of which are corrected by the frequency characteristic correction unit 28, and outputs the adjusted cancel signals. Note that the cancel signal for the left ear is output to a left supplier 23L, which is attached to headphones 21 worn by a listener on the head, and is used to directly supply a sound according to the signal to the left ear of the listener. Also, the cancel signal for the right ear is output to a right supplier 23R, which is attached to the headphones 21 worn by the listener on the head, and is used to directly supply a sound according to the signal to the right ear of the listener.

Note that processing for storing opposite phase signals in the transfer function storage unit 17 as data has to be executed prior to reproduction of the binaural signal supplied from the binaural sound source unit 11. The sound reproduction apparatus according to this embodiment has two operation modes; that is, the reproduction mode and measurement mode, and operates according to the set mode.

In the reproduction mode, the sound signal for the right ear is supplied to the right loudspeaker 15R, the cancel signal for the right ear is supplied to the right supplier 23R, the sound signal for the left ear to the left loudspeaker 15L, and the cancel signal for the left ear to the left supplier 23L. On the other hand, the measurement mode is executed to generate the opposite phase signals for the right and left ears. The arithmetic controller 12 may be one of these mode according to an operation of the user at an operation unit (not shown) or according to the sequence of processing.

The operation of the sound reproduction apparatus when the measurement mode is set will be described first. When the measurement mode is set, the arithmetic controller 12 notifies the measurement signal generator 16 and selector/mixer 13 of that mode. Upon reception of this notification, the measurement signal generator 16 outputs the measurement signal to the selector/mixer 13. Furthermore, upon reception of this notification, the selector/mixer 13 outputs the measurement signal from the measurement signal generator 16 to the amplifier 14.

Since the amplifier 14 amplifies this measurement signal and then outputs the amplified signal to the left loudspeaker 15L, a sound according to this amplified measurement signal is produced from the left loudspeaker 15L. The produced sound is collected by a condenser microphone 22L attached to the left supplier 23L of the headphones 21 and by a condenser microphone 22R attached to the right supplier 23R. Impulse response signals collected by the respective condenser microphones 22R and 22L are signals including transfer functions from the left loudspeaker 15L to both the ears of the listener (in case of FIG. 1, the right and left suppliers 23R and 23L).

A microphone amplifier/AD converter 20 amplifies and A/D-converts the impulse response signal from the condenser microphone 22R of the condenser microphones 22R and 22L, thereby generating digital data (first acquisition).

The arithmetic controller 12 calculates a "transfer function HLR of a crosstalk signal from the left loudspeaker 15L to the right ear" using the digital data generated by the microphone amplifier/AD converter 20. Then, the arithmetic controller 12 generates, from the calculated transfer function HLR as an impulse response, an opposite phase signal to the impulse response, and stores the generated signal in the transfer function storage unit 17 as an opposite phase signal for the right ear (first generation).

Upon completion of the storage processing of this opposite phase signal for the right ear, the arithmetic controller 12 controls the amplifier 14 to amplify the measurement signal and output the amplified signal to the right loudspeaker 15R. Hence, from this right loudspeaker 15R, a sound according to this amplified measurement signal is produced.

Next, the microphone amplifier/AD converter 20 amplifies and A/D-converts the impulse response signal from the condenser microphone 22L of the condenser microphones 22R and 22L, thus generating digital data (second acquisition).

Next, the arithmetic controller 12 calculates a "transfer function HRL of a crosstalk signal from the right loudspeaker 15R to the left ear" using the digital data generated by the microphone amplifier/AD converter 20. Then, the arithmetic controller 12 generates, from the calculated transfer function HRL as an impulse response, an opposite phase signal to that impulse response, and stores the generated signal in the transfer function storage unit 17 as an opposite phase signal for the left ear (second generation).

Then, upon completion of processing for storing the opposite phase signals for the right and left ears in the transfer function storage unit 17 as digital data, the arithmetic controller 12 switches the operation mode to the reproduction mode.

Next, the operation of the sound reproduction apparatus in the reproduction mode will be described below. As described above, a binaural signal is supplied from the binaural sound source unit 11. When the reproduction mode is set, the arithmetic controller 12 notifies the selector/mixer 13 of that mode. Hence, the selector/mixer 13 outputs the binaural signal supplied from the binaural sound source unit 11 to the amplifier 14 and cancel signal generator 18.

The amplifier 14 amplifies this binaural signal, and outputs sound signals for the right and left eyes, respectively, to the right and left loudspeakers 15R and 15L.

Upon reception of the binaural signal from the selector/mixer 13, the cancel signal generator 18 convolutes the opposite phase signal for the right ear stored in the transfer function storage unit 17 to the sound signal for the left ear included in the sound signal as this binaural signal. With this convolution, the cancel signal generator 18 generates a cancel signal for the right ear. Likewise, the cancel signal generator 18 convolutes the opposite phase signal for the left ear stored in the transfer function storage unit 17 to the sound signal for the right ear included in the sound signal as this binaural signal. With this convolution, the cancel signal generator 18 generates a cancel signal for the left ear.

Figure 3:
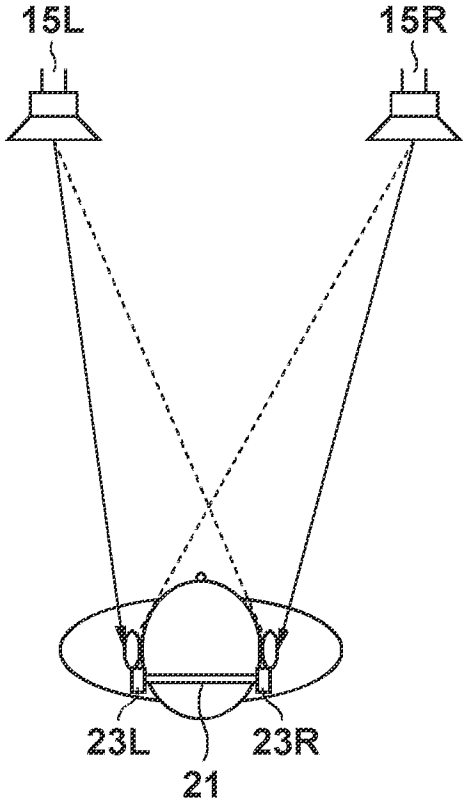
FIG. 3 is a view for explaining cancel signals to be output.
Figure 2:
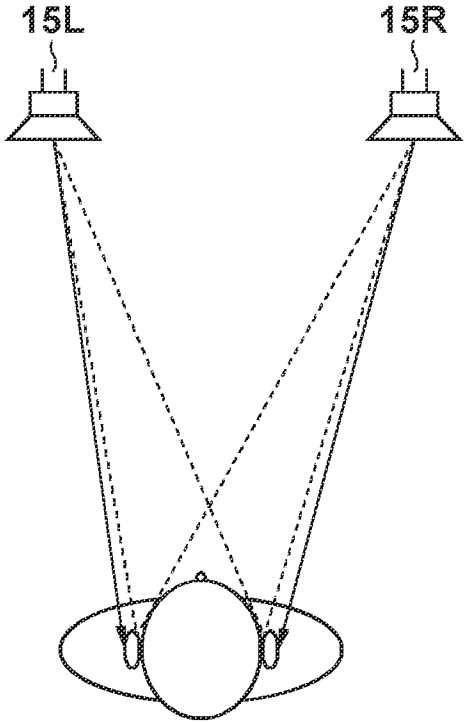
FIG. 2 is a view for explaining an arrangement for reproducing three-dimensional sounds.

The cancel signals for the right and left ears are respectively processed by the frequency characteristic correction unit 28 and delay/sound volume controller 19, and are then output to the right and left suppliers 23R and 23L, as shown in FIG. 3.

As the right and left suppliers 23R and 23L, for example, bone conduction headphones can be used. The bone conduction headphones produce vibrations to the head bone without covering the ears in order to allow a listener to listen to a sound. Hence, unlike normal headphones, the bone conduction headphones never disturb listening to reproduced sounds from the right and left loudspeakers 15R and 15L.

For this reason, the crosstalk cancel signals are reproduced by the bone conduction headphones to superpose −HRL*R and −HLR*L on sounds SL' and SR', which reach the respective ears, in internal ear portions, as given by equation (1). Hence, crosstalk components from the loudspeakers on the sides opposite to the ears can be canceled in the internal ear portions.

$$SL'=HLL*SL+HRL*SR-HRL*SR \quad (3)$$

$$SR'=HRR*SR+HLR*SL-HLR*SL \quad (4)$$

With this arrangement, crosstalk cancel signals need not be superposed on signals from the loudspeakers. For this reason, by storing crosstalk cancel functions at respective listeners' positions, and applying the cancel processing for respective listeners, simultaneous listening of a plurality of listeners is allowed.

The frequency characteristic correction unit 28 will be described below. The correction characteristic correction unit 28 corrects frequency characteristics of auxiliary sound sources such as the aforementioned bone conduction headphones. When the frequency characteristics of the loudspeakers are different from those of the suppliers, crosstalk cancel precision lowers. Hence, the frequency characteristics of the loudspeakers have to be roughly matched with those of the suppliers. In this case, the frequency characteristics are corrected using a filter having a linear phase such as an FIR. Filter coefficients may be decided in advance by measurements.

The bone conduction headphones cannot undergo measurements using normal microphones. Hence, some frequencies are reproduced in practice, and are compared with sounds produced by the loudspeakers, thus deciding characteristics and filter coefficients. Of course, in case of suppliers whose characteristics are known, the filter coefficients may be set to adjust these characteristics to those of the loudspeakers.

Next, the delay/sound volume controller 19 will be described below. Upon convolution of an impulse response at the ear position, delay information to some extent is included. Since a time period required until a signal from a bone conduction generator is perceived is different from that of air conduction, wearing positions on the head, personal differences, and the like are included. As a countermeasure, the user may be allowed to adjust the wearing position. Also, due to reproduction efficiency of the auxiliary sound sources and personal differences, the user may also adjust the sound volume.

Figure 4:
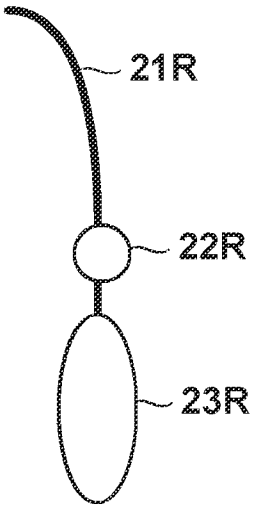
FIG. 4 is view showing an example of an auxiliary sound source applicable to headphones 21.

FIG. 4 shows an example of the auxiliary sound sources applicable to the headphones 21. FIG. 4 shows only an arrangement on the right side, but the same applies to that on the left side. As shown in FIG. 4, an arrangement 21R on the right side includes the right supplier 23R as a bone conduction generation portion and the condenser microphone 22R as a sound collecting unit used to collect a sound. The condenser microphone 22R receives electric power from the microphone amplifier/AD converter 20, and amplifies and A/D-converts a DC-cut signal to be used in calculations.

In this manner, the condenser microphones are arranged in the vicinity of the ears, so as to measure characteristics at the right and left ear positions. Note that the supplier is not limited to bone conduction, but it may include, for example, a compact loudspeaker which can produce a sound without covering an external ear canal like full-open type headphones. That is, any other sound producing members may be used as the supplier as long as they do not intercept a sound from the loudspeaker.

Figure 5:
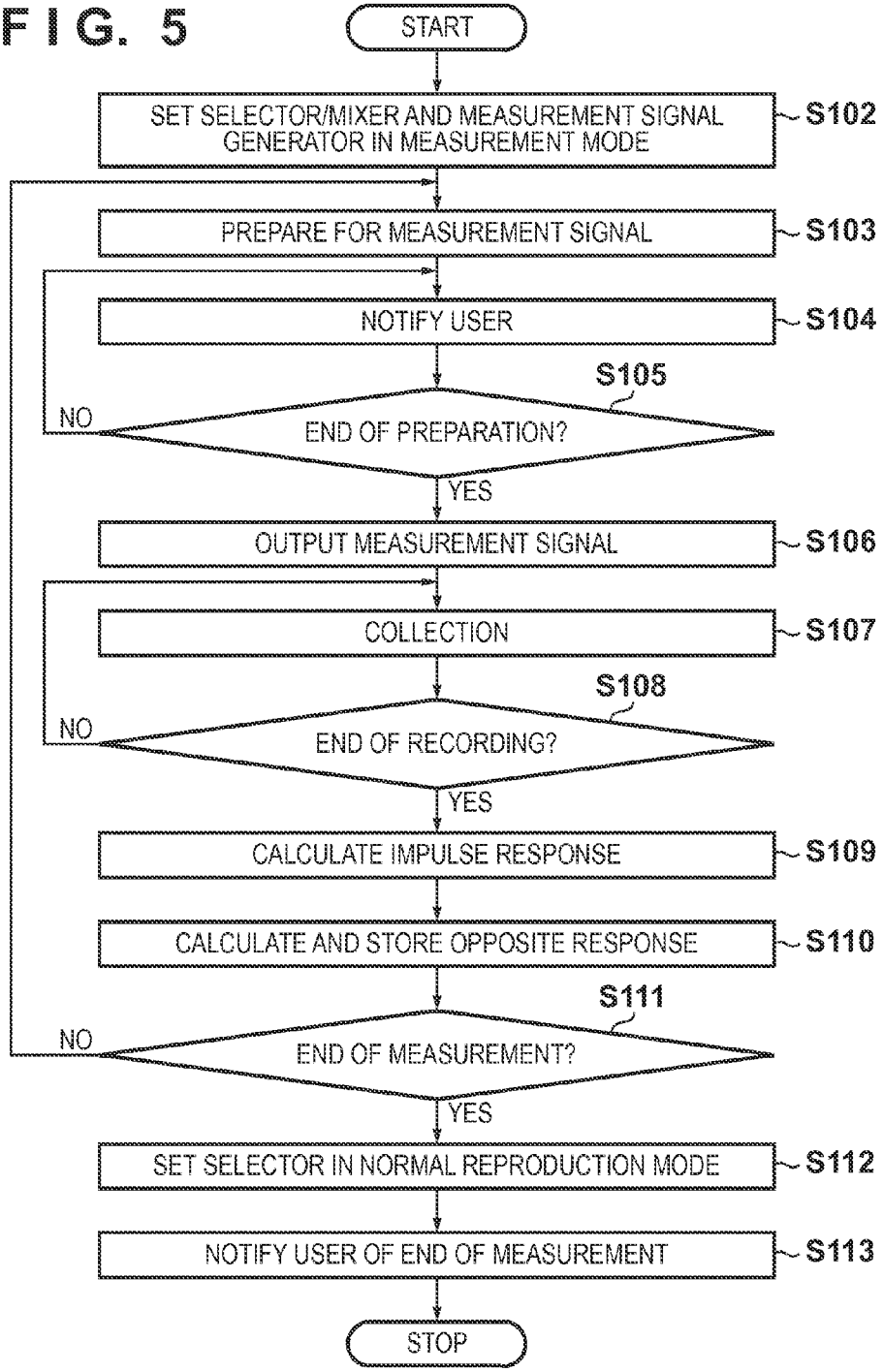
FIG. 5 is a flowchart of processing executed by the sound reproduction apparatus in a measurement mode.

The aforementioned processing executed by the sound reproduction apparatus when the measurement mode is set will be described below with reference to FIG. 5, which shows the flowchart of that processing. When the measurement mode is set, the arithmetic controller 12 notifies the measurement signal generator 16 and selector/mixer 13 of that mode in step S102. In step S103, the measurement signal generator 16 makes a preparation for outputting a measurement signal.

In step S104, the arithmetic controller 12 instructs the listener to wear the headphones 21 on the head and to move to a listening point. The instruction method is not limited to a specific method. For example, a message or moving image which instructs the listener to wear the headphone 21 and to move to a listening point may be displayed on a display screen (not shown).

After the user wears the headphones 21 on the head and moves to the listening point, he or she notifies the sound reproduction apparatus of completion of the preparation. The notification method is not limited to a specific method. For example, the user may notify the sound reproduction apparatus of completion of the preparation using a remote controller or the like.

When the arithmetic controller 12 detects the notification indicating completion of the preparation, the process advances to step S106 via step S105; otherwise, the process returns to step S104 via step S105.

In step S106, the measurement signal generator 16 outputs a measurement signal to the selector/mixer 13, which outputs the measurement signal from the measurement signal generator 16 to the amplifier 14. Then, the amplifier 14 amplifies this measurement signal and outputs the amplified signal to the left loudspeaker 15L. Hence, this left loudspeaker 15L produces a sound according to the amplified measurement signal. Also, the arithmetic controller 12 controls the microphone amplifier/AD converter 20 to start signal collection in this step.

In step S107, the microphone amplifier/AD converter 20 amplifies and A/D-converts an impulse response signal from the condenser microphone 22R of the condenser microphones 22R and 22L, thus generating digital data. Collection of the impulse response signal from the condenser microphone 22R is continued until a level (sound volume) of this impulse response signal becomes not more than a prescribed value. Therefore, when the level (tone volume) of the impulse response signal is more than the prescribed value, the process returns to step S107 via step S108 to continue to collect the impulse response signal. On the other hand, if the level (sound volume) of the impulse response signal becomes not more than the prescribed value, the process advances to step S109 via step S108 to end collection of the impulse response signal. Note that the collection end condition of the impulse response signal is not limited to this. For example, collection may end when a time period corresponding to distance between the headphones 21 and the loudspeaker elapses from the beginning of sound production from that loudspeaker.

In step S109, the arithmetic controller 12 calculates the "transfer function HLR of a crosstalk signal from the left loudspeaker 15L to the right ear (strictly speaking, the condenser microphone 22R)" using the digital data generated by the microphone amplifier/AD converter 20. This calculation can be quickly made if Hadamard transformation or the like is used.

In step S110, the arithmetic controller 12 generates an opposite phase signal to the impulse response from the transfer function HLR calculated in step S109, and stores the generated signal in the transfer function storage unit 17 as an opposite phase signal for the right ear.

The arithmetic controller 12 judges in step S111 whether or not both opposite phase signals for the right and left ears are generated. As a result of this judgment, if both the signals are generated, the process advances to step S112; if the other signal is not generated, the process returns to step S103. In case of this description, since the opposite phase signal for the right ear is generated first, the processes of step S103 and subsequent steps are executed so as to generate an opposite phase signal for the left ear next.

In step S112, the arithmetic controller 12 switches the operation mode to the reproduction mode. In step S113, the arithmetic controller 12 notifies the user of completion of the measurements. This notification method is also not limited to a specific method. For example, a message or moving image indicating that the measurements are complete may be displayed on the display screen.

Note that in the above description, the opposite phase signal for the right ear is generated first, and that for the left ear is then generated. However, the order is not limited to this, and these signals may be generated in a reversed order.

Also, this embodiment has explained the arrangement required to generate the "opposite phase signal for the right ear" and "opposite phase signal for the left ear" at a certain listening point. Therefore, when the same processing is applied respectively to a plurality of listening points, "opposite phase signals for the right ear" and "opposite phase signals for the left ear" at the respective listening points can be generated. In this case, information (identifier or the like) unique to each listening point and the "opposite phase signal for the right ear" and "opposite phase signal for the left ear" generated at that listening point can be stored in a memory such as the transfer function storage unit 17 in association with each other.

In the reproduction mode, when listening points of respective listeners are designated, the "opposite phase signals for the right ear" and "opposite phase signals for the left ear" for these listening points can be specified. Hence, cancel signals can be generated for the respective listening points. Therefore, since the cancel signals for the listening points of the listeners can be provided for the respective listeners, a plurality of listeners can simultaneously experience three-dimensional realistic sounds.

Second Embodiment

When the first embodiment is applied, since transfer functions are not convoluted to sounds from loudspeakers, correction signals according to respective transfer functions are generated at a plurality of positions, thereby generating cancel signals for respective listening points. For this reason, a plurality of listeners can experience three-dimensional realistic sounds at the same time. However, the first embodiment is premised on that a head position of each listener is fixed.

This embodiment will explain a sound reproduction apparatus which can cope with a movement of a head position by switching cancel signals according to ear positions of a listener. Note that only differences from the first embodiment will be described below, and other parts are the same as the first embodiment.

Figure 6:
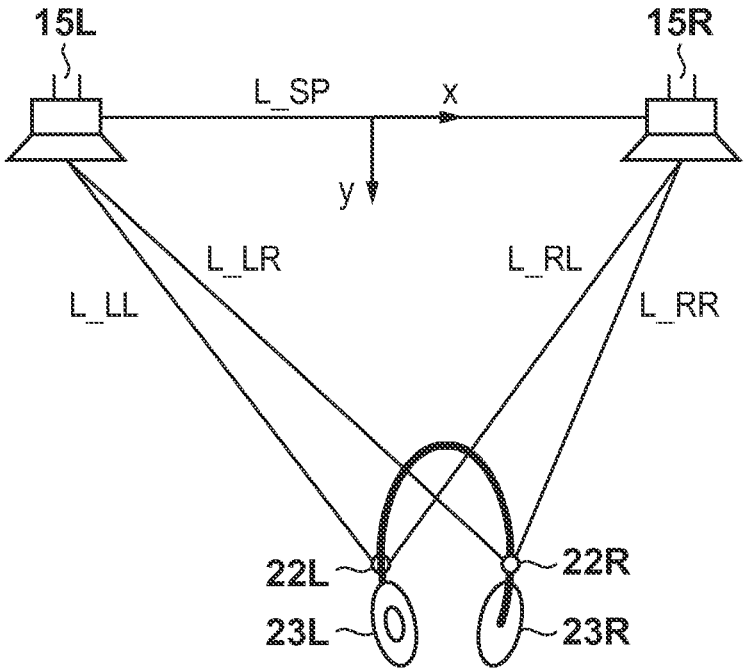
FIG. 6 is a view showing the positional relationship between respective loudspeakers and respective condenser microphones.

FIG. 6 shows the positional relationship between right and left loudspeakers 15R and 15L and condenser microphones 22R and 22L. Let L_SP be a distance between the right and left loudspeakers 15R and 15L. Also, let L_RR and L_RL be distances from the right loudspeaker 15R to the condenser microphones 22R and 22L, and L_RL and L_LL be distances from the left loudspeaker 15L to the condenser microphones 22R and 22L. Furthermore, an origin in FIG. 6 is a midpoint position between the positions of the right and left loudspeakers 15R and 15L, and x and y axes are defined in horizontal and vertical directions. Hence, a coordinate position of the left loudspeaker 15L is (−L_SP/2, 0), and that of the right loudspeaker 15R is (L_SP/2, 0).

In this state, assuming that a head of a listener is at nearly the same level as the right and left loudspeakers 15R and 15L, a coordinate position (XL, YL) of the condenser microphone 22L is given by:

$$XL=(L_LL^2-L_LR^2)/2\times L_SP$$

$$YL=\mathrm{SQRT}((L_SP/2+XL)^2-L_LL^2)$$

Likewise, assuming that the head of the listener is at nearly the same level as the right and left loudspeakers 15R and 15L, a coordinate position (XR, YR) of the condenser microphone 22R is given by:

$$XR=(L_RL^2-L_RR^2)/2\times L_SP$$

$$YR=\mathrm{SQRT}((L_SP/2+XR)^2-L_RR^2)$$

Note that the distance between the loudspeaker and microphone can be measured by measuring, as an arrival time, a time from when a burst wave falling outside an audible frequency range is produced from the loudspeaker as a measurement signal unit it is collected by the microphone. Since a propagation speed Va of a sonic wave in air is about 340 m/sec, the distance between the loudspeaker and microphone can be measured by multiplying the measured time by this speed.

Since the propagation speed changes depending on temperature, a sound may be recorded at a given point (for example, a point of 1 m) from one loudspeaker before the measurement, and a distance may be calibrated based on that time. Alternatively, a temperature may be measured actually, and may be used in correction.

As for details of actual operations, since an existing technique such as distance measurement using ultrasonic waves can be used, a detailed description thereof will not be given. A burst signal as a reference sound is produced, and the reference sound is collected and stored using a microphone. From the stored sound recorded signal, an arrival time from sound production until recording is calculated and detected using an auto-correlation or the like, and is multiplied by a propagation speed, thus calculating a distance from a loudspeaker. Then, a position is calculated using the above equations. At the time of position information detection, it is important to measure a distance using a propagation time in air by excluding fixed values of circuits, processes, and the like. On the other hand, when the head height of the listener is largely different from that of the loudspeaker, a position can be calculated by expanding the aforementioned two-dimensional coordinates to three-dimensional coordinates.

In three-dimensional position measurements, a loudspeaker or sound producing member which can produce a measurement signal is additionally set at a point other than that on a line connecting the right and left loudspeakers, and distances between the loudspeakers and those from the added loudspeaker are also measured.

Since the positions of the right and left microphones can be detected, the apparatus is configured to also measure distances at measurement timings of crosstalk characteristics of the first embodiment, and crosstalk cancel transfer functions are stored in association with position coordinates.

Figures 9, 10:
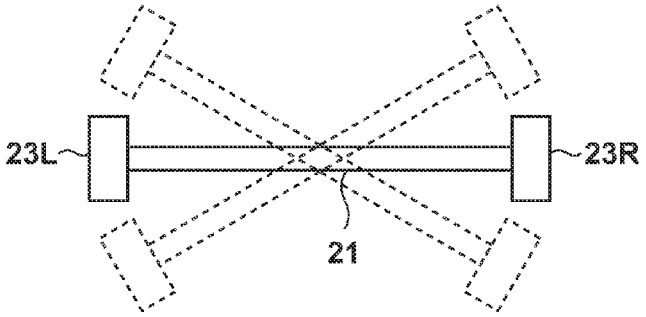
FIG. 9 is a view showing a modification.
FIG. 10 shows a configuration example of table information.
Figure 11:
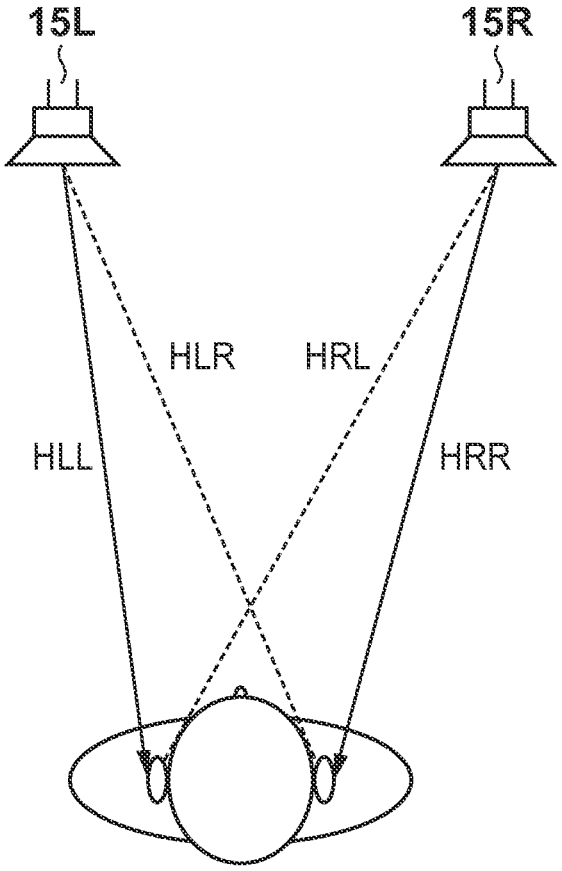
FIG. 11 is a view for explaining crosstalk in binaural reproduction.

Therefore, the sound reproduction apparatus according to this embodiment manages table information shown in FIG. 10 in its appropriate internal memory. This table information is created in a measurement mode. That is, the table information is created by acquiring an impulse response signal for each of a plurality of positions, and associating an impulse response (transfer function) calculated from the acquired impulse response signal with a region including the corresponding position.

For example, the condenser microphone 22L is set at a certain position (x, y), and a sound from the right loudspeaker 15R is collected by the condenser microphone 22L at this set position (x, y), thus acquiring an impulse response signal. Then, using fixed values dx and dy, Xmin=x−dx, Xmax=x+dx, Ymin=y−dy, and Ymax=y+dy are calculated. Then, table information, which associates an impulse response calculated from the impulse response signal collected by the condenser microphone 22L at the set position (x, y) with a region defined by a range in the x direction from Xmin to Xmax and a range in the y direction from Ymin to Ymax, is created. The same operations are also executed for the condenser microphone 22R (in case of the condenser microphone 22R, a sound from the left loudspeaker 15L is collected).

In case of FIG. 10, transfer functions calculated from impulse response signals collected by the condenser microphones 22R and 22L when they are set at a position (xa, ya) are respectively a transfer function L→R and transfer function R→L. Then, these transfer functions and a region A including the position (xa, ya) are associated with each other. The region A is defined by a range in the x direction from Xamin (=xa−dx) to Xamax (=xa+dx) and a range in the y direction from Yamin (=ya−dy) to Yamax (=ya+dy). Therefore, in the table information, these Xamin, Xamax, Yamin, and Yamax, and the transfer function L→R and transfer function R→L at the position (xa, ya) are registered in association with each other. The same applies to regions B and C.

Note that dx and dy are set according to a size of a maximum region which can prevent the region A from overlapping another region and can use the same transfer functions. The same applies to the regions B and C.

Note that when the condenser microphone 22L (22R) is set at a plurality of positions, dx and dy may be decided to have a midpoint between the respective set positions as a boundary of a region. In this manner, the setting method of dx and dy is not limited to a specific method. Also, the configuration of the table information is not limited to that shown in FIG. 10 as long as when the condenser microphone 22L (22R) is set at a plurality of positions, an impulse response for the left ear and that for the right ear calculated for each position are managed in association with a region including that position.

Figure 7:
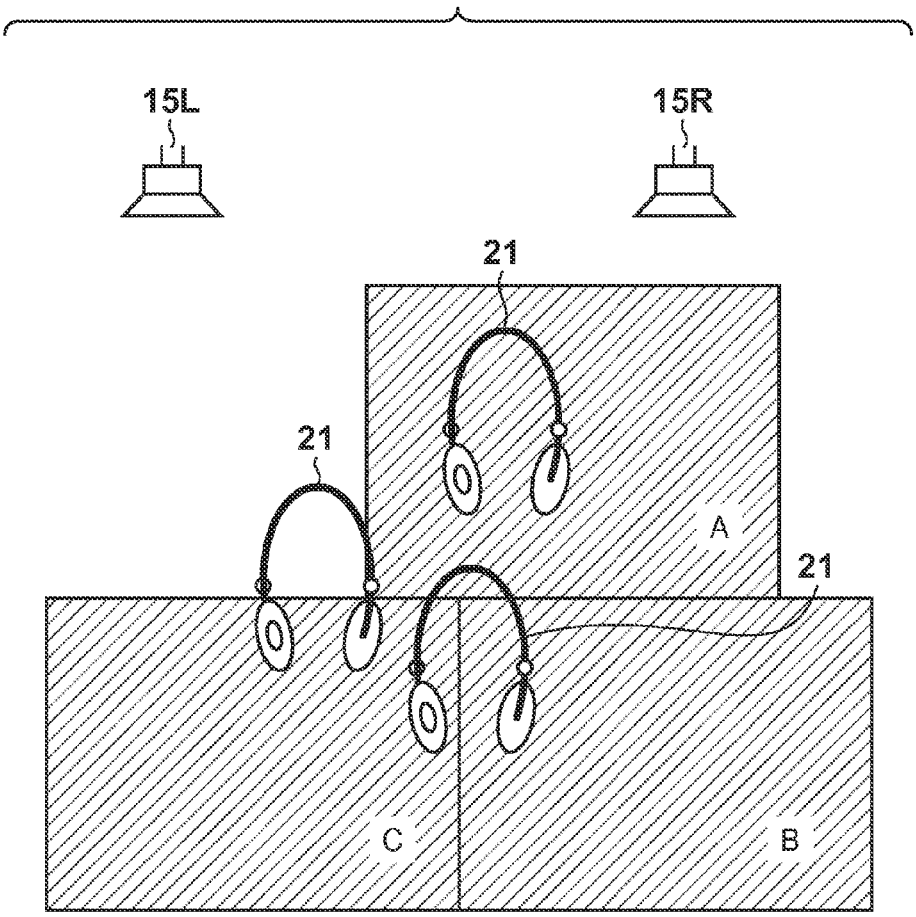
FIG. 7 is a view for explaining generation and use of table information.

Generation and use of the table information exemplified in FIG. 10 will be described below using FIG. 7. Impulse responses calculated for a certain position in the region A are used when the condenser microphone 22L (22R) is located within the region A in a reproduction mode. Also, impulse responses calculated for a certain position in the region B are used when the condenser microphone 22L (22R) is located within the region B in the reproduction mode. Furthermore, impulse responses calculated for a certain position in the region C are used when the condenser microphone 22L (22R) is located within the region C in the reproduction mode.

As for position detection of the condenser microphone 22L (22R) in the reproduction mode, since the distance is measured using a sound outside an audible range, as described above, a measurement sound such as a burst sound is output appropriately to detect the position of the condenser microphone 22L (22R) as needed. In this way, since the head position can be detected in real time, correction at that position can be made.

Note that the condenser microphone 22L is located within the region B and the condenser microphone 22R is located with the region C in the reproduction mode. In this case, to a left supplier 23L, a cancel signal based on the transfer function for the region B is calculated and output. Also, to a left supplier 23L, a cancel signal based on the transfer function for the region C is calculated and output. In this manner, the transfer functions according to the positions of the respective suppliers can be used.

Figure 8:
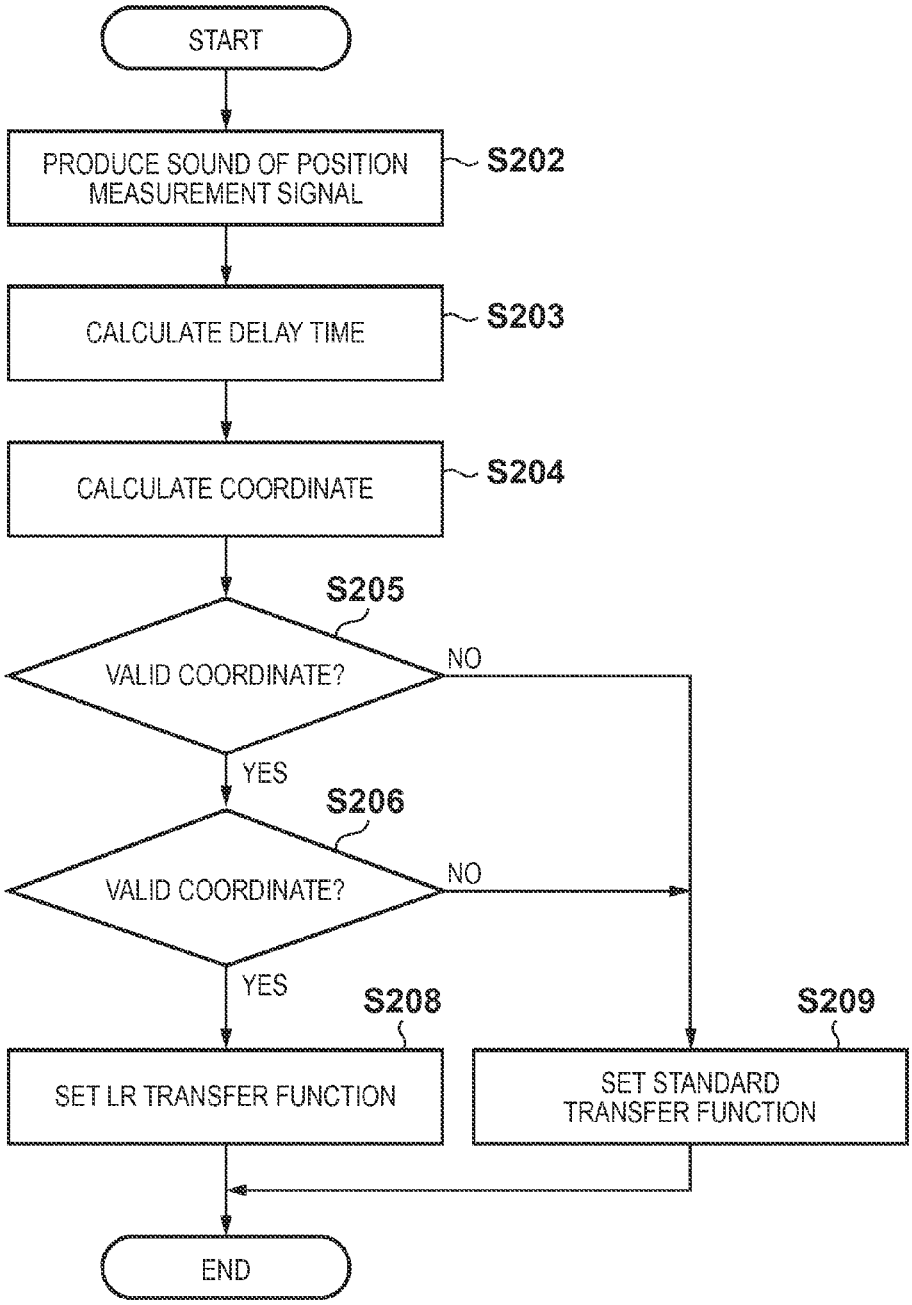
FIG. 8 is a flowchart of processing executed by the sound reproduction apparatus in a reproduction mode.

Processing to be executed by the sound reproduction apparatus in the reproduction mode in this embodiment will be described below with reference to FIG. 8 which shows the flowchart of that processing.

In step S202, a measurement signal generator 16 generates a burst signal as a signal required to measure (detect) the position of the microphone. When a frequency of this burst signal is set to fall outside an audible range, a distance can be measured without disturbing reproduction even during normal reproduction. A selector/mixer 13 outputs the burst signal from the measurement signal generator 16 to an amplifier 14 together with sound signals from a binaural sound source unit 11. Of course, as in the first embodiment, the selector/mixer 13 also outputs the sound signals from the binaural sound source unit 11 to a cancel signal generator 18.

The amplifier 14 outputs amplified sound signals. However, the amplifier 14 outputs the burst signal, the frequency of which is changed to different frequencies for the right and left loudspeakers 15R and 15L. This is to identify the loudspeaker which outputs a collected sound based on the frequency of the collected sound on the collection side of sounds according to burst waves.

Then, the right loudspeaker 15R outputs a sound according to the sound signal for the right ear, and also outputs a sound (burst wave) according to the burst signal, the frequency of which is changed for the right loudspeaker 15R. On the other hand, the left loudspeaker 15L outputs a sound according to the sound signal for the left ear, and also outputs a sound according to the burst signal, the frequency of which is changed for the left loudspeaker 15L. Of course, without changing the frequency, one loudspeaker may output a sound according to the burst signal first, and after processing for that loudspeaker ends, the other loudspeaker may output a sound according to the burst signal.

In any case, the burst wave produced from each loudspeaker is delayed by a time depending on a distance between the loudspeaker and microphone, and is collected by that microphone, which outputs a signal according to the collected sound.

Therefore, in step S203, a microphone amplifier/AD converter 20 extracts high-frequency components by applying filter processing or the like to the signal from the condenser microphone 22L (22R), and further makes auto-correlation calculations or the like, thus calculating a delay time of the burst wave. This delay time can be calculated by subtracting a time required for circuits and processes from a time from the generation timing of the burst wave at the loudspeaker until the detection timing of the burst wave by the microphone.

Then, in step S204, an arithmetic controller 12 multiplies the delay time calculated in step S203 by the propagation speed in air, and further calculates the current position of the condenser microphone 22L (22R) using the above equations required to calculate XL, YL, XR, and YR. At this time, a temperature may also be measured to correct the speed.

The arithmetic controller 12 judges in step S205 whether or not the position calculated in step S204 falls within a predetermined range. As a result of judgment, if the position calculated in step S204 falls within the predetermined range, the process advances to step S206. On the other hand, if the position calculated in step S204 falls outside the predetermined range, the process advances to step S209.

In step S209, the arithmetic controller 12 instructs the cancel signal generator 18 to use the previously used transfer function or predetermined transfer function. The predetermined transfer functions may be those for, for example, a region close to a central portion of some regions shown in FIG. 7. Of course, the transfer functions created by the user may be used.

On the other hand, in step S206, the arithmetic controller 12 searches the table information shown in FIG. 10 for a region to which the position calculated in step S204 belongs (a region which includes an x-coordinate value of this position within the range in the x direction and a y-coordinate value within the range in the y direction). Then, the arithmetic controller 12 judges whether or not the region to which the position belongs is valid. If the arithmetic controller 12 judges that the region is valid, the process advances to step S208; otherwise, the process advances to step S209.

In other words, the determination process of step S206 is to determine whether or not transfer functions are measured or defined in a region defined by the table information shown in FIG. 10.

In step S208, the arithmetic controller 12 instructs the cancel signal generator 18 to use transfer functions registered in the table information in association with the region searched in step S206.

With the above processing, since the arithmetic controller 12 can issue an instruction of transfer functions to be used to the cancel signal generator 18, the cancel signal generator 18 (or the arithmetic controller 12) generates opposite phase signals of impulse responses from the transfer functions in the same manner as in the first embodiment. The subsequent processes are the same as those in the first embodiment.

Note that in the above processing, when the microphones move across regions, the transfer functions to be used suddenly change, and a listener may listen to abnormal noise at that time. Hence, processing for changing the transfer functions gradually or at a break timing of a sound may be added so as not to generate abnormal noise or the like. By sequentially executing the aforementioned processing, the movement of the head can be detected to change correction functions. Hence, even when the head is moved, satisfactory correction can be made.

Also, as shown in FIG. 9, correction coefficients are finely decided in correspondence with turns of the head, thus coping with a case in which a sitting position is fixed but only the head turns. In this way, characteristics are measured in advance in association with movements of a listener, and accurate correction functions can be used in correspondence with changes in head position (ear position), thus allowing accurate correction.

When this embodiment is applied to each of a plurality of listeners, the plurality of listeners can listen to the sounds at the same time as in the first embodiment. In this case, the arrangement to be added to this embodiment is as has been described in the first embodiment.

In this embodiment, transfer functions for respective regions are managed, and correction functions are selected in correspondence with movement of the head position. However, when the apparatus is free from the influence of movement, this embodiment may be used in delay time adjustment, sound volume adjustment, and the like in accordance with distances from the loudspeakers. With this arrangement, deficiencies and excesses about cancel signals can be compensated for. Of course, the correction function change processing and delay amount/sound volume change processing may be simultaneously executed.

In this embodiment, position detection is attained by outputting a sound outside the audible range from the loudspeaker. However, position detection may be attained by other methods. For example, when an upper limit frequency which can be produced by the loudspeaker falls within the audible range, a frequency within the audible range may be set as long as it does not cause an obstruction against listening.

Alternatively, light such as infrared light may be emitted from headphones 21 in place of a sound, and this light position may be calculated to detect the head position. Also, such a technique may be combined with the detection method of this embodiment. Alternatively, an image sensing device such as a camera may be arranged between the loudspeakers to recognize a face of each listener and to decide his or her position.

Note that the transfer functions are managed for respective regions in this embodiment. However, in place of the transfer functions, opposite phase signals of impulse responses indicated by the transfer functions may be managed. Thus, the need for generating opposite phase signals from the transfer functions by the cancel signal generator 18 in the reproduction mode can be obviated.

Third Embodiment

All the units shown in FIG. 1 may be implemented by hardware. Alternatively, some units such as the cancel signal generator 18 and frequency characteristic correction unit 28 may be implemented by software (computer programs). In this case, this software is stored in a memory such as a RAM or ROM, and is executed by the arithmetic controller 12 to implement the corresponding functions.

Fourth Embodiment

Figure 12:
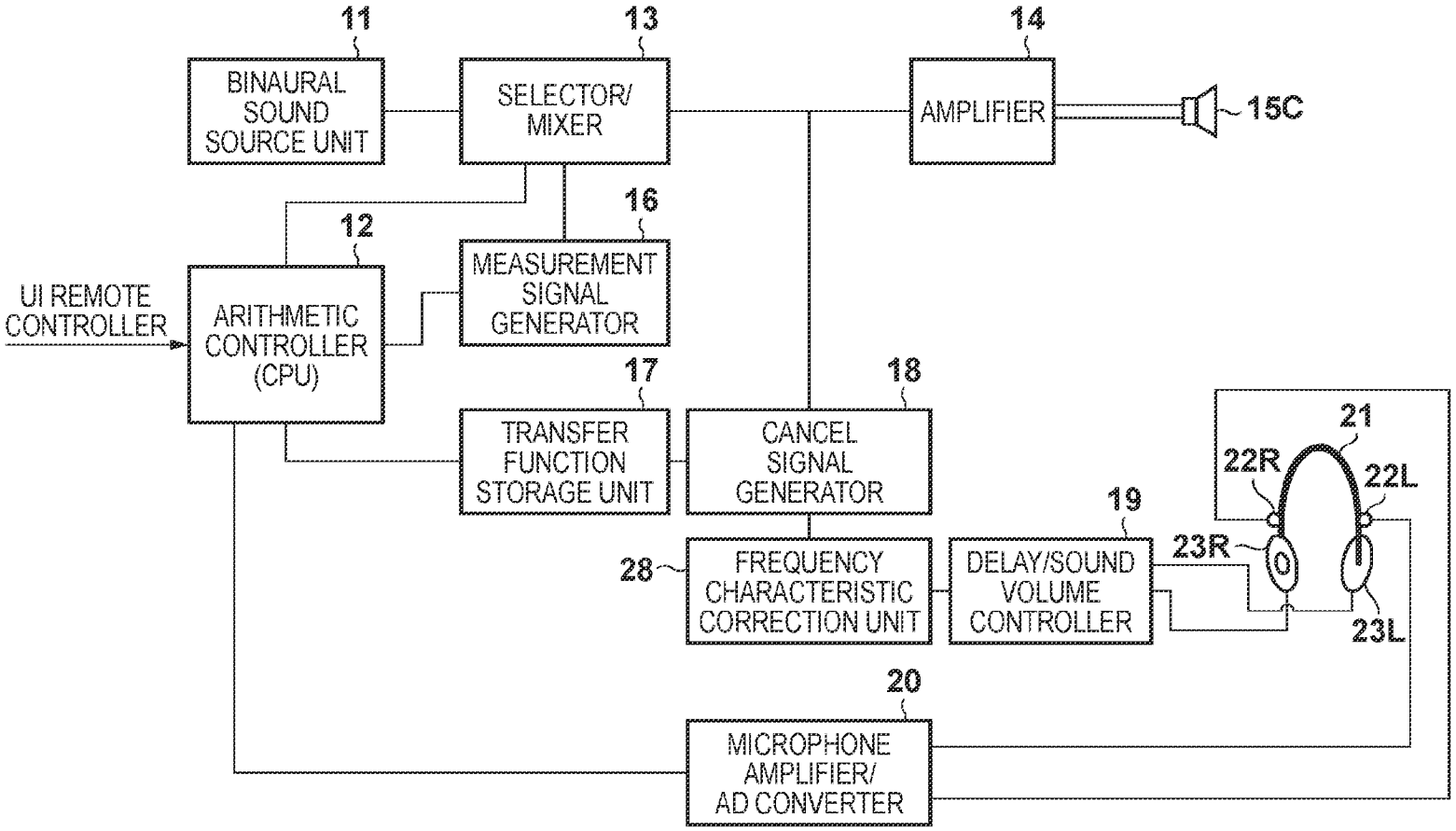
FIG. 12 is a block diagram showing an example of the functional arrangement of a sound reproduction apparatus.

An example of the functional arrangement of a sound reproduction apparatus according to this embodiment will be described below with reference to the block diagram shown in FIG. 12. In FIG. 12, the same reference numerals denote the same components as those shown in FIG. 1, and a description thereof will not be repeated.

Figure 13:
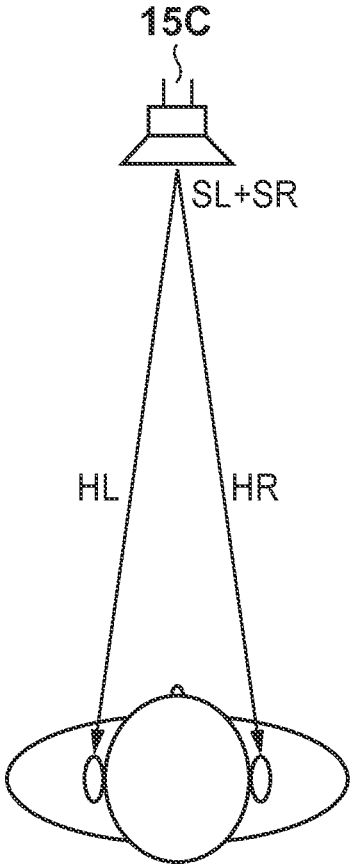
FIG. 13 is a view for explaining binaural signals to be output.

In the first and second embodiments, binaural signals (SL, SR) are respectively output from left and right loudspeakers. However, in this embodiment, a center loudspeaker 15C outputs a signal (SL+SR) as a combination of left and right signals, as shown in FIG. 13. An output sound is transferred from the loudspeaker to the left and right ears to have transfer functions HL and HR, and reaches the respective ears as HL(SL+SR) and HR(SL+SR).

For this signal, these transfer functions are measured in advance and opposite phase signals are generated to correct the signal. For example, a correction signal −HL*SR for the left ear and a signal −HR*SL for the right ear are supplied to corresponding suppliers. In this manner, HL*(SL+SR)−HL*SR=HL*SL is supplied to the left ear, and a listener can listen to only a binaural signal for the left ear. Also, the listener can listen to only a signal for the right ear.

In this embodiment, since transfer functions are not convoluted in a sound from the loudspeaker as in the first and second embodiment, correction signals according to transfer functions are generated at each of a plurality of positions, thus allowing a plurality of listeners to simultaneously listen to the sound.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-119069 filed May 24, 2012 which is hereby incorporated by reference herein in its entirety.

What is claimed is:

1. A sound processing apparatus, comprising:

a first control unit that controls loudspeakers to output sound signals as a binaural signal;

a position acquisition unit that acquires positions where listeners listen to the sound signals;

an acquisition unit that acquires, for each of the listeners, collection results of a first and second collection units of the listener each of which collects a sound, wherein the first and second collection units of the listener are respectively attached to a first supplier of the listener configured to supply a sound and a second supplier of the listener configured to supply a sound; and a second control unit that (i) controls for each of the listeners, on the basis of the acquired position of the listener and the collection result by the first collection unit of the listener when the loudspeakers output sound signals, the first supplier of the listener different from the loudspeakers to output a signal cancelling a sound signal for a right ear output from the loudspeaker, and (ii) controls for each of the listeners, on the basis of the acquired position of the listener and the collection result by the second collection unit of the listener when the loudspeakers output sound signals, the second supplier of the listener different from the loudspeakers to output a signal cancelling a sound signal for a left ear output from the loudspeaker.

2. The apparatus according to claim 1, further comprising:

a unit that acquires for each of the listeners a first transfer function between each of the loudspeakers and the first collection unit of the listener on the basis of the collection result by the first collection unit of the listener when the loudspeakers output the sound signals, and acquires for each of the listeners a second transfer function between each of the loudspeakers and the second collection unit of the listener on the basis of the collection result by the second collection unit of the listener when the loudspeakers output the sound signals, wherein the second control unit controls for each of the listeners, on the basis of the acquired position of the listener and the first transfer function acquired for the listener, the first supplier of the listener to output the signal cancelling the sound signal for a right ear output from the loudspeaker, and controls for each of the listeners, on the basis of the acquired position of the listener and the second transfer function acquired for the listener, the second supplier of the listener to output the signal cancelling the sound signal for a left ear output from the loudspeaker.

3. The apparatus according to claim 2, wherein the first transfer function acquired for each of the listeners is based on an impulse response signal which is output from the loudspeaker and collected by the first collection unit of the listener, and the second transfer function acquired for each of the listeners is based on an impulse response signal which is output from the loudspeaker and collected by the second collection unit of the listener.

4. The apparatus according to claim 1, wherein the second control unit controls for each of the listeners the first supplier of the listener to output opposite phase signal of the sound signal for a right ear, and controls for each of the listeners the second supplier of the listener to output opposite phase signal of the sound signal for a left ear.

5. The apparatus according to claim 1, wherein the loudspeakers are plural speakers which output respective the sound signal for a right ear and the sound signal for a left ear.

6. The apparatus according to claim 1, wherein the second control unit controls for each of the listeners, on the basis of a position of the first supplier of the listener, a sound signal to be output by the first supplier of the listener, and controls, on the basis of a position of the second supplier of the listener, a sound signal to be output by the second supplier of the listener.

7. The apparatus according to claim 1, further comprising:

a unit that sets one of a reproduction mode and a measurement mode, wherein the second control unit controls for each of the listeners, on the basis of the acquired position of the listener and the collection result by the first collection unit of the listener when the loudspeakers output sound signals in the measurement mode, the first supplier of the listener to output the signal cancelling the sound signal for a right ear output from the loudspeaker in the reproduction mode, and controls for each of the listeners, on the basis of the acquired position of the listener and the collection result by the second collection unit of the listener when the loudspeakers output sound signals in the measurement mode, the second supplier of the listener to output the signal cancelling the sound signal for a left ear output from the loudspeaker in the reproduction mode.

8. The apparatus according to claim 1, wherein the first second and second suppliers are bone conduction headphones.

9. The apparatus according to claim 1, wherein the first and second suppliers are full-open type headphones.

10. The apparatus according to claim 8, wherein the first supplier is for a left ear of a listener and the second supplier is for a right ear of the listener.

11. The apparatus according to claim 1, wherein the second control unit controls for each of the listeners the first supplier of the listener not to output the signal cancelling the sound signal for a left ear, and controls the second supplier of the listener not to output the signal cancelling the sound signal for a right ear.

12. A sound processing method for a sound processing apparatus, comprising:

first controlling loudspeakers to output sound signals as a binaural signal;

acquiring positions where listeners listen to the sound signals;

acquiring, for each of the listeners, collection results of first and second collection units of the listener each of which collects a sound, wherein the first and second collection units of the listener are respectively attached to a first supplier of the listener configured to supply a sound and a second supplier of the listener configured to supply a sound; and second (i) controlling for each of the listeners, on the basis of the acquired position of the listener and the collection result by the first collection unit of the listener when the loudspeakers output sound signals, the first supplier of the listener different from the loudspeakers to output a signal cancelling a sound signal for a right ear output from the loudspeaker, and (ii) controlling for each of the listeners, on the basis of the acquired position of the listener and the collection result by the second collection unit of the listener when the loudspeakers output sound signals, the second supplier of the listener different from the loudspeakers to output a signal cancelling a sound signal for a left ear a-output from the loudspeaker.

13. A non-transitory computer-readable storage medium on which is stored a program which when implemented causes a computer to perform a sound processing method for a sound processing apparatus, the method comprising:

first controlling loudspeakers to output sound signals as a binaural signal;

acquiring positions where listeners listen to the sound signals;

acquiring, for each of the listeners, collection results of first and second collection units of the listener each of which collects a sound, wherein the first and second collection units of the listener are respectively attached to a first supplier of the listener configured to supply a sound and a second supplier of the listener configured to supply a sound; and second (i) controlling for each of the listeners, on the basis of the acquired position of the listener and the collection result by the first collection unit of the listener when the loudspeakers output sound signals, the first supplier of the listener different from the loudspeakers to output a signal cancelling a sound signal for a right ear output from the loudspeaker, and (ii) controlling for each of the listeners, on the basis of the acquired position of the listener and the collection result by the second collection unit of the listener when the loudspeakers output sound signals, the second supplier of the listener different from the loudspeakers to output a signal cancelling a sound signal for a left ear a-output from the loudspeaker.

* * * * *